US007845596B2

(12) United States Patent
Hershey et al.

(10) Patent No.: US 7,845,596 B2
(45) Date of Patent: Dec. 7, 2010

(54) HOT RAIL WHEEL BEARING DETECTION SYSTEM AND METHOD

(75) Inventors: John Erik Hershey, Ballston Lake, NY (US); Pierino Gianni Bonanni, Loudonville, NY (US); Harry Kirk Mathews, Jr., Clifton Park, NY (US); Brock Estel Osborn, Niskayuna, NY (US)

(73) Assignee: Progress Rail Services Corporation, Albertville, AL (US)

( * ) Notice: Subject to any disclaimer, the term of this patent is extended or adjusted under 35 U.S.C. 154(b) by 219 days.

(21) Appl. No.: 12/122,583

(22) Filed: May 16, 2008

(65) Prior Publication Data

US 2008/0283681 A1 Nov. 20, 2008

Related U.S. Application Data

(60) Provisional application No. 60/938,475, filed on May 17, 2007.

(51) Int. Cl.
*B61K 9/00* (2006.01)

(52) U.S. Cl. ..... 246/169 A

(58) Field of Classification Search ..... 246/167 R, 246/169 A, 169 D; 250/339.04, 339.05; 340/682; 702/40, 134, 135, 136
See application file for complete search history.

(56) References Cited

U.S. PATENT DOCUMENTS

2003/0102965 A1* 6/2003 Hemed ..... 340/435
2006/0131464 A1* 6/2006 Hesser et al. ..... 246/169 D

* cited by examiner

*Primary Examiner*—Mark T Le

(57) ABSTRACT

A system for detecting a hot surface is provided. The system includes a sensor for sensing an infrared radiation radiating from the hot surface and a high pass filter to eliminate low frequency components from the sensor signal. The system also includes an absolute value module to compute absolute values of a filtered signal, a first comparator to compare output of the absolute value module to a first threshold and a peak detector to report a peak value of the sensor signal's output. The system further includes a second comparator to compare output of peak detector to a second threshold.

17 Claims, 3 Drawing Sheets

HOT RAIL WHEEL BEARING DETECTION SYSTEM AND METHOD

CROSS REFERENCE TO RELATED APPLICATIONS

This application is a non-provisional application of the provisional application Ser. No. 60/938,475, filed May 17, 2007, which is herein incorporated by reference.

BACKGROUND

The present invention relates generally to detection of abnormally hot rail car wheel bearing surfaces, and more specifically to signal processing of infrared signals emitted by hot surfaces of such bearings and surrounding structures.

Railcars riding on wheel trucks occasionally develop overheated bearings. The overheated bearings may eventually fail and cause costly disruption to rail service. Many railroads have installed wayside hot bearing detectors (HBDs) that view the bearings and surrounding structure surfaces as a rail car passes, and generate an alarm upon detection of an abnormally hot surface. One of the commonly used techniques includes employing sensors in the HBDs that sense heat generated by the bearing surfaces. For example, pyroelectric sensors may be used that depend upon the piezoelectric effect. However, such sensors can be susceptible to noise due to mechanical motion of the railcars. Such noise may result from so-called microphonic artifacts, and can complicate the correct diagnosis of hot bearings, or even cause false positive readings. In general, false positive readings, although false, nevertheless require stopping a train to verify whether the detected bearing is, in fact, overheating, leading to costly time delays and schedule perturbations.

Accordingly, an improved system and method that would address the aforementioned issues is needed.

BRIEF DESCRIPTION OF THE INVENTION

In accordance with one exemplary embodiment of the present invention, a system for detecting a moving hot bearing or wheel of a rail car includes a sensor for sensing radiation from the hot bearing or wheel. A high pass filter is configured to eliminate low frequency components from signals from the sensor. A first comparator configured to compare the filtered sensor signals to a first threshold, and a peak detector configured to report a peak value of the sensor signals. A second comparator configured to compare output of the peak detector to a second threshold.

In accordance with another embodiment of the present invention, system for detecting a moving hot bearing or wheel of a rail car includes a sensor for sensing radiation from the hot bearing or wheel. The system further includes stability criteria test circuitry to determine stability of the sensor signal and to output a signal indicative that a bearing or wheel is abnormally hot based upon the sensor signal stability.

The invention also provides a method for detecting a moving hot bearing or wheel of a rail car. The method includes detecting signals from the hot bearing or wheel, high pass filtering the signals, comparing the filtered detected signals to a first threshold, detecting peaks in the detected signals, and comparing the peaks to a second threshold to determine whether the hot bearing or wheel is likely hotter than desired. The filtered signals may be processed to determine an absolute value, and the first comparison may be made between the absolute value of the filtered signals and the first threshold. Moreover, the peak detector may be enabled and disabled from applying output signals for comparison to the second threshold based upon the comparison of the filtered signals to the first threshold.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
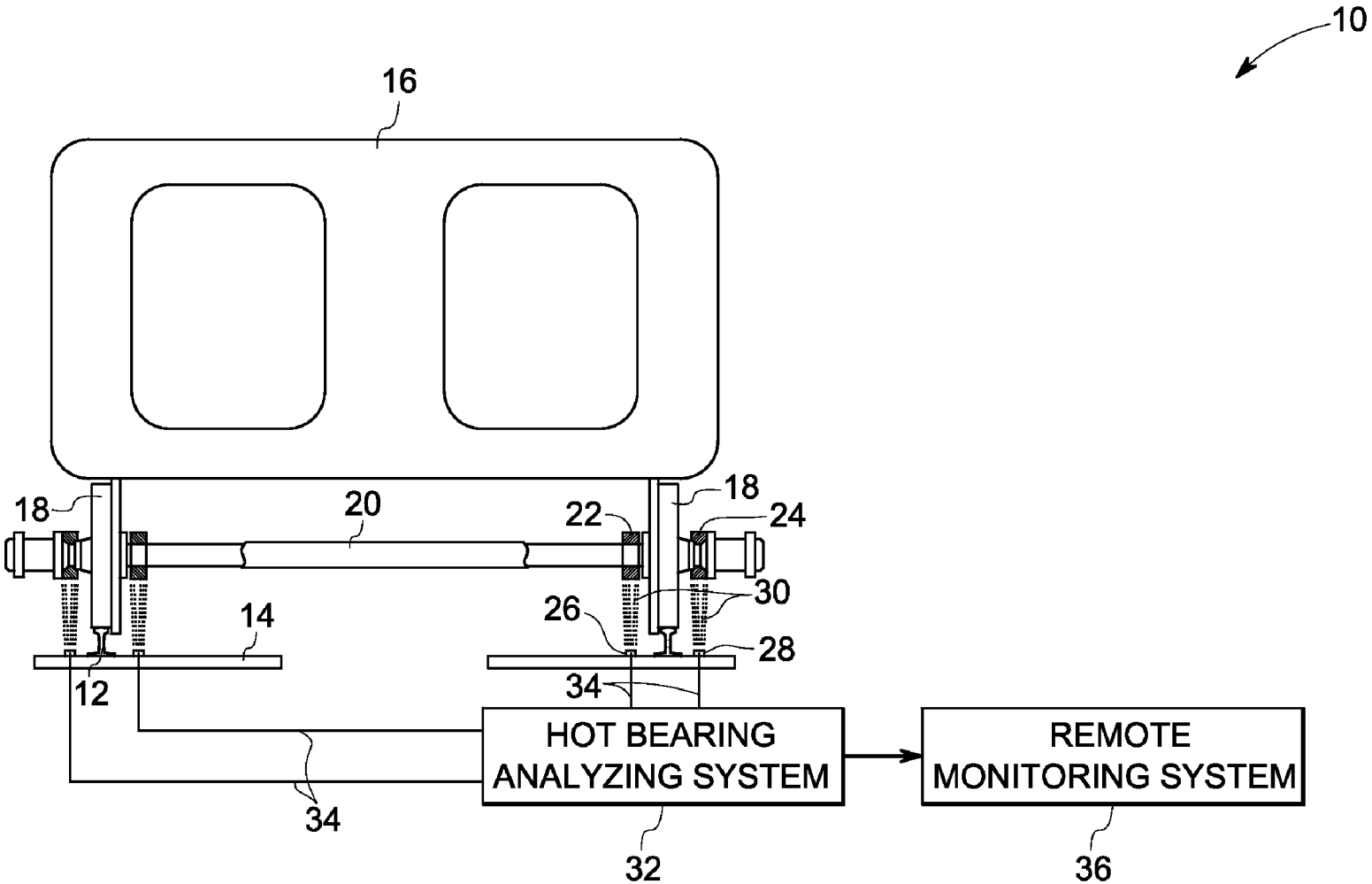
FIG. 1 is a diagrammatical representation of an exemplary system for detecting hot rail car bearings and wheel surfaces.

Referring now to the drawings, FIG. 1 illustrates an exemplary rail car bearing and wheel surface temperature detection system 10, shown disposed adjacent to a railroad rail 12 and a crosstie 14. A railway vehicle or car 16 includes multiple wheels 18, typically mounted in sets or trucks. An axle 20 connects wheels 18 on either side of the rail car. The wheels are mounted on and can freely rotate on the axle by virtue of bearings 22 and 24.

One or more sensors 26, 28 are disposed along a path of the railroad track to obtain data from the wheel bearings. As in the illustrated embodiment, an inner bearing sensor 26 and an outer bearing sensor 28 may be positioned in a rail bed on either side of the rail 12 adjacent to or on the cross tie 14 to receive infrared emission 30 from the bearings 22, 24. Examples of such sensors include, but are not limited to, infrared sensors, such as those that use pyrometer sensors to process signals. In general, such sensors detect radiation emitted by the bearings and/or wheels, which is indicative of the temperature of the bearings and/or wheels. In certain situations, the detected signals may require special filtering to adequately distinguish signals indicative of overheating of bearings from noise, such as microphonic noise. Such techniques are described below.

A wheel sensor (not shown) may be located inside or outside of rail 12 to detect the presence of a railway vehicle 16 or wheel 18. The wheel sensor may provide a signal to circuitry that detects and processes the signals from the bearing sensors, so as to initiate processing by a hot bearing or wheel analyzing system 32. In the illustrated embodiment, the bearing sensor signals are transmitted to the hot bearing analyzing system 32 by cables 34, although wireless transmission may also be envisaged. From these signals, the analyzing system 32 filters the received signals as described below, and determines whether the bearing is abnormally hot, and generates an alarm signal to notify the train operators that a hot bearing has been detected and is in need of verification and/or servicing. The alarm signal may then be transmitted to an operator room (not shown) by a remote monitoring system 36. Such signals may be provided to the on-board operations personnel or to monitoring equipment entirely remote from the train, or both.

Figure 2:
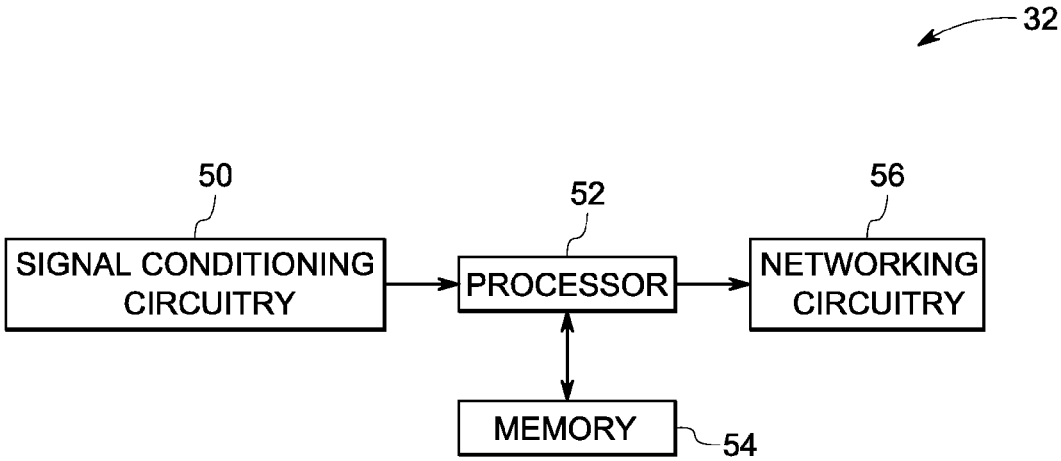
FIG. 2 is a diagrammatical representation of functional components of the hot bearing detection system of FIG. 1.

FIG. 2 is a diagrammatic representation of the functional components of the hot bearing analyzing system 32. The output of inner bearing sensor 26, outer bearing sensor 28 and the wheel sensor are processed via signal conditioning circuitry 50. Signal conditioning circuitry 50 may convert the sensor signals into digital signals, perform filtering of the signals, and the like. It should be noted that the circuitry used to detect and process the sensed signals, and to determine whether a bearing and/or wheel is hotter than desired, may be digital, analog, or a combination. Thus, where digital circuitry is used for processing, the conditioning circuitry will generally include analog-to-digital conversion, although analog processing components will generally not require such conversion.

Output signals from the signal conditioning circuitry are then transmitted to processing circuitry 52. The processing circuitry 52 may include digital components, such as a programmed microprocessor, field programmable gate array, application specific digital processor or the like, implementing routines as described below. It should be noted, however, that certain of the schemes outlined below are susceptible to analog implementation, and in such cases, circuitry 52 may include analog components. In one embodiment, the processor 52 includes a filter to eliminate noise from the electrical signal. In another embodiment, the processing circuitry 52 includes a peak detector for detecting a maximum value of the filtered signal and a comparator for comparing the maximum value of the filtered signal to a predefined threshold to produce an alarm signal.

The processing circuitry 52 may have an input port (not shown) that may accept commands or data required for presetting the processing circuitry. An example of such an input is a decision threshold (e.g., a value above which a processed signal is considered indicative of an overheated bearing and/or wheel). The particular value assigned to any of the thresholds discussed herein may be chosen readily by those skilled in the art using basic techniques of signal detection theory, including, for example, analysis of the sensor system "receiver operating characteristic." As an example, if the system places very high importance on minimizing missed detection (i.e., false negatives), the system may be set with lower thresholds so as to reduce the occurrence rate of missed detections to the maximum tolerable rate. On the other hand, the system thresholds may be set higher so as to reduce the rate of "false positives" while still achieving a desired detection rate, coinciding with maintaining an acceptable level of "false negatives". In general, and as described below, both types of false determinations may be reduced by the present processing schemes. As also described below, the system may implement an adaptive approach to setting of the thresholds, in which thresholds are set and reset over time to minimize occurrences of both false negative and false positive determinations.

When digital circuitry is used for processing, the processing circuitry will include or be provided with memory 54. In one embodiment processing circuitry 52 utilizes programming, and may operate in conjunction with analytically or experimentally derived radiation data stored in the memory 54. Moreover, memory 54 may store data for particular trains, including information for each passing vehicle, such as axle counts, and indications of bearings and/or wheels in the counts that appear to be near or over desired temperature limits. Processed information, such as information identifying an overheated bearing or other conditions of a sensed wheel bearing, may be transmitted via networking circuitry 56 to a remote monitoring system 36 for reporting and/or notifying system monitors and operators of degraded bearing conditions requiring servicing.

Figure 3:
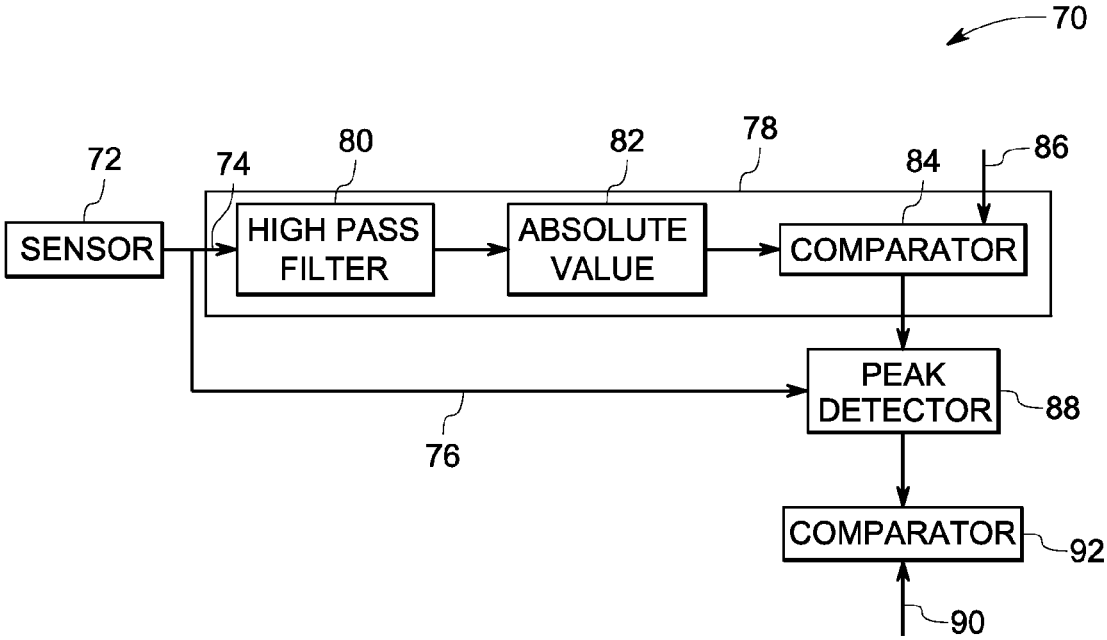
FIG. 3 represents a stability method of detecting hot rail car bearing or wheel surface in accordance with one embodiment of present invention.

FIG. 3 represents an exemplary stability method 70 of detecting hot rail car bearings or wheel surfaces in accordance with one embodiment of present invention. In general, the system includes signal stability test circuitry that determines whether the signal is sufficiently persistent to output a signal indicative that the bearing or wheel is abnormally hot. Such test circuitry may, for example, determine a standard deviation of the input sensor signal over a window of time or samples. It may also determine maximum and minimum values over the time or sample window. In the implementation described below, an output signal may be provided by enabling or disabling a peak detector based upon signal stability.

In the embodiment illustrated in FIG. 3, a signal output of sensor 72 is split into two branches 74, 76. The first branch 74 is input to a stability criteria module 78 that determines signal stability according to one or more criteria. In the exemplary embodiment shown, the stability is determined by first passing the sensor signal output through a high pass filter 80. The output of the high pass filter 80 is input to an absolute value module 82 that computes the absolute values of the high pass filter outputs. The high pass filter 80 and absolute value module 82 together block low frequency signals from input signal branch 74 and pass only high frequency signal or noise components. The output of the absolute value module 82 is input to a comparator 84 that compares the output of the absolute value module 82 to a threshold 86. The comparator enables a peak detector 88 to report the peak value of the sensor signal outputs in branch 76 up to that time. In other words, when there is a large amount of noise in the input signal 74, the comparator 84 disables the peak detector 88 and the comparator 84 enables the peak detector 88, only when the input signal 74 is relatively noise free. Thus only relatively stable sensor data is passed through the peak detector 88. The output of the peak detector is compared to a decision threshold 90 by another comparator 92 that issues a decision concerning the presence or absence of a hot rail car surface. As noted above, in other embodiments, the stability criteria module or test circuitry may include other conditions of determining stability of the sensor signal such as but not limited to determining standard deviation over a signal window of the sensor signal.

Figure 4:
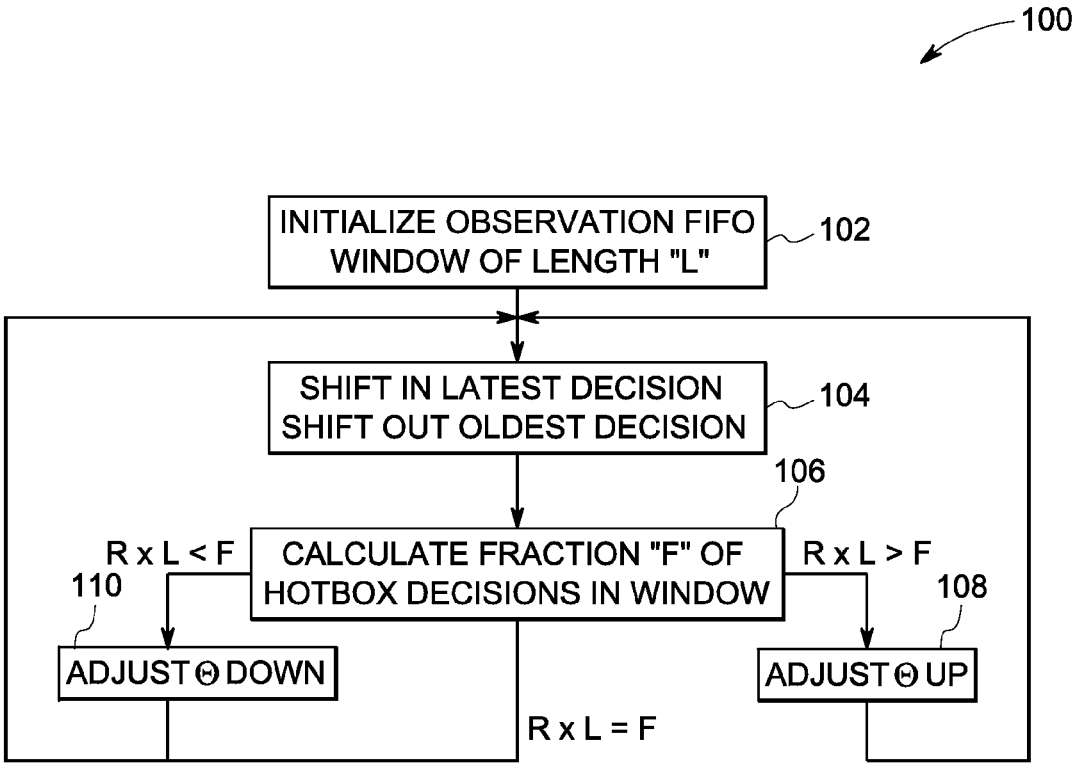
FIG. 4 represents a decision threshold adjustment algorithm in accordance with an embodiment of the present invention.

In the stability method described above, the decision threshold may be fixed, or can be adjusted dynamically. FIG. 4 represents the decision threshold adaptive algorithm 100. A first in first out (FIFO) window of length L is initialized at start in step 102. The FIFO window of length L contains the decisions regarding the differentiation of abnormally hot rail car bearings and/or wheels and normally hot rail car surfaces. In step 104, old values of threshold are removed and new values are updated. Decision regarding the differentiation of abnormally hot rail car surfaces and normally hot rail car surfaces is taken in step 106. If R×L is less than F, then the decision threshold, Θ, is increased in step 108, where R is a rate at which alarm is generated and F is a number of decisions for an abnormally hot rail car surface within the FIFO window. If R×L is greater than F, the decision threshold is decreased in step 110. If it is equal, the decision threshold is maintained constant.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system for detecting a moving hot bearing or wheel of a rail car comprising:

a sensor for sensing radiation from the hot bearing or wheel;

a high pass filter configured to generate filtered sensor signals by eliminating low frequency components from signals from the sensor;

a first comparator configured to compare the filtered sensor signals to a first threshold;

a peak detector configured to report a peak value of the sensor signals; and a second comparator configured to compare output of the peak detector to a second threshold.

2. The system of claim 1, comprising an absolute value module configured to compute absolute values of the filtered signals for application to the first comparator, and wherein the first comparator compares the absolute values of the filtered signals to the first threshold.

3. The system of claim 1, wherein the peak detector is enabled and disabled from outputting signals based upon the comparison by the first comparator.

4. The system of claim 1, wherein at least one of the filter, the first comparator, the peak detector and the second detector is implemented in programmed digital processor.

5. The system of claim 1, wherein at least one of the filter, the first comparator, the peak detector and the second detector is implemented in an analog domain.

6. The system of claim 1, wherein the second threshold is adjusted during operation of the system.

7. The system of claim 6, wherein the second threshold is adjusted based upon a FIFO analysis of decisions.

8. The system of claim 1, wherein the first comparator is further configured to disable the peak detector when there is a noise in an output signal of the sensor.

9. A method for detecting a moving hot bearing or wheel of a rail car comprising:

detecting signals from the hot bearing or wheel;

high pass filtering the signals;

comparing the filtered detected signals to a first threshold;

detecting peaks in the detected signals; and comparing the peaks to a second threshold to determine whether the hot bearing or wheel is likely hotter than desired.

10. The method of claim 9, comprising enabling and disabling the peak detector from outputting signals for comparison based upon the comparison of the filtered signals to the first threshold.

11. The method of claim 9, comprising determining absolute values of the filtered signals, and wherein the filtered signals compared to the first threshold are absolute values of the filtered signals.

12. The method of claim 9, wherein the second threshold is adjusted during operation processing of the signals.

13. The method of claim 12, wherein the second threshold is adjusted based upon a FIFO analysis of decisions.

14. The method of claim 9, comprising outputting a notification indicating that a bearing or wheel is hotter than desired.

15. The method of claim 14, comprising transmitting the notification to a location remote from a train in which the rail car is part.

16. The method of claim 9, wherein at least one of the high pass filtering, the comparison of the filtered detected signals, and the peak detection is implemented in an analog domain.

17. The method of claim 9, wherein detecting peaks further comprises detecting peaks in the detected signals when the detected signals are noise free.

* * * * *